United States Patent [19]

Matejec et al.

[11] Patent Number: 4,770,980

[45] Date of Patent: Sep. 13, 1988

[54] MULTILAYER COLOR PHOTOGRAPHIC RECORDING MATERIAL WHEREIN A RED SECONDARY SENSITIVITY IS PRODUCED IN THE BLUE AND GREEN LAYERS

[75] Inventors: Reinhart Matejec; Erwin Ranz, both of Leverkusen, Fed. Rep. of Germany

[73] Assignee: Agfa-Gevaert AG, Leverkusen, Fed. Rep. of Germany

[21] Appl. No.: 61,712

[22] Filed: Jun. 15, 1987

[30] Foreign Application Priority Data

Jun. 28, 1986 [DE] Fed. Rep. of Germany ..... 3621764

[51] Int. Cl.[4] ..... G03C 1/46

[52] U.S. Cl. ..... 430/502; 430/504; 430/505; 430/506

[58] Field of Search ..... 430/504, 505, 506, 502

[56] References Cited

U.S. PATENT DOCUMENTS

| | | | |
|---|---|---|---|
| 3,252,795 | 11/1963 | De Ramaix et al. | 430/504 |
| 3,892,572 | 7/1975 | Shiba et al. | 430/504 |
| 4,273,861 | 6/1981 | Shiba et al. | 430/505 |
| 4,276,372 | 6/1981 | Wernicke et al. | 430/505 |
| 4,387,159 | 6/1983 | Engelmann et al. | 430/505 |
| 4,423,142 | 12/1983 | Janssens | 430/505 |

*Primary Examiner*—Paul R. Michl
*Assistant Examiner*—Patrick A. Doody
*Attorney, Agent, or Firm*—Connolly & Hutz

[57] ABSTRACT

A color photographic recording material comprising at least one layer of which the primary sensitivity is blue, another layer of which the primary sensitivity is green and a further layer of which the primary sensitivity is red, gives satisfactory density graduations for details of high color saturation when a red sensitivity is produced in at least one layer, of which the primary sensitivity is green, and in at least one layer, of which the primary sensitivity is blue, the primary sensitivity being 8 to 25 DIN higher than the secondary sensitivity.

7 Claims, 7 Drawing Sheets

Figure 1:
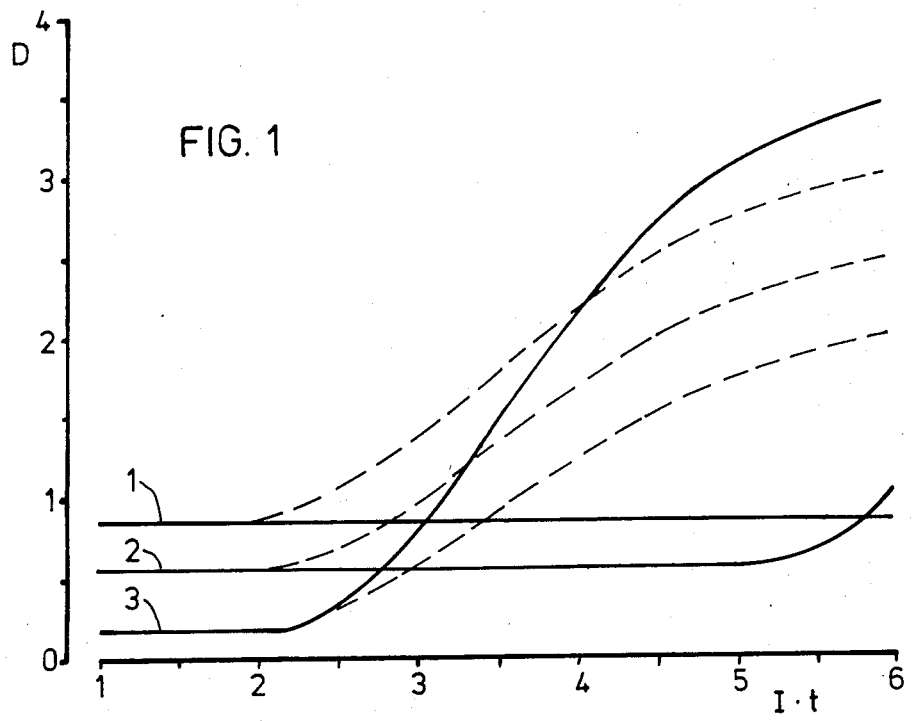

D
4
3
2
1
0
1
2
3
1
2
3
4
5
6
I·t

D
4
3
2
1
0
1
2
3
1
2
3
4
5
6
I·t

MULTILAYER COLOR PHOTOGRAPHIC RECORDING MATERIAL WHEREIN A RED SECONDARY SENSITIVITY IS PRODUCED IN THE BLUE AND GREEN LAYERS

This invention relates to a color photographic recording material which gives satisfactory density graduations for details of high color saturation.

It is known both with color negative material and with color reversal material that color reproduction can be improved by the so-called inter-image effect (IIE), cf. T. H. James, The Theory of the Photographic Process, 4th Edition, McMillan Co. N.Y. (1977), pp. 574 and 614.

The IIE is measured as the percentage steepening of the color gradation obtained with color separation exposure to light of the corresponding spectral region in relation to the color gradation obtained on exposure to white light.

In the case of color negative material, the IIE is generally produced by DIR couplers whereas, with color reversal material, the IIE is generally produced by $Ag^+$-complexing agents, such as $SCN^-$, in the reversal first developer.

One known disadvantage of a high IIE is the inadequate, often totally non-existent density graduation of details in the case of colors showing high color saturation, particularly reds. For example, red roses are generally reproduced merely as undifferentiated red patches, in which the reproduction of detail is extremely poor, by high-IIE color material.

However, an improvement in the reproduction of detail by better density graduation is desirable with other colors as well.

The object of the present invention is to modify high-IIE color material in such a way that density graduations are better discernible, even in details of high color saturation, without the high color quality obtained by the high IIE being significantly impaired.

It has now been found that it is possible to reproduce details of high color saturation, surprisingly without any significant reduction in color quality, providing the color photographic recording material is modified in such a way that, on exposure to light of a certain spectral region (for example red), a certain color gradation is established beyond a certain quantity of light of that spectral region, even in those colors (for example magenta and yellow) of which the color layers are not normally affected by this spectral region (for example by red light) for the corresponding quantities of light.

To enable the effects to be better described, the following nomenclature is used in the present specification:

The color density of that color which is formed on exposure to light of a certain spectral region (dominant) is referred to as "primary color density" (on exposure to red light, this is cyan in the color negative system), while the color densities of the other two colors (in this example, magenta and yellow) are referred to as "secondary color densities".

Accordingly, that spectral sensitivity for which the silver halide grains of a certain layer are dominantly sensitive (for example the red sensitivity of the silver halide grains in the cyan layer) is referred to as primary sensitivity while the sensitivities of this layer for the other spectral regions are referred to as secondary spectral sensitivities.

It is known from U.S. Pat. No. 3,252,795 that a silver halide emulsion layer containing a cyan coupler can be sensitized both for red light and for green light. In combination with this layer, the photographic material, of which the function is to avoid color falsification, contains only a red-sensitized layer containing a magenta coupler and a green-sensitive layer containing a yellow coupler, in other words the color couplers do not couple complementarily to the spectral sensitivity of those layers. In addition, no IIE is produced.

Accordingly, the present invention relates to a color photographic recording material comprising at least one layer of which the primary sensitivity is blue, another layer of which the primary sensitivity is green and a further layer of which the primary sensitivity is red, which layers contain the particular color couplers coupling complementarily thereto and of which the IIE is at least 5% and preferably at least 10% in the blue-sensitive layer and in the red-sensitive layer and at least 10% and preferably at least 15% in the green-sensitive layer, characterized in that a red secondary sensitivity is produced in at least one layer of which the primary sensitivity is green and in at least one layer of which the primary sensitivity is blue, the primary sensitivity being 8 to 25 DIN and preferably 12 to 20 DIN higher than the secondary sensitivity in either case.

In addition, a blue secondary sensitivity is preferably produced in at least one layer of which the primary sensitivity is green and in at least one layer of which the primary sensitivity is red and a green sensitivity is produced in at least one layer of which the primary sensitivity is blue and in at least one layer of which the primary sensitivity is red, the above-mentioned differences in sensitivity having to be maintained.

In addition, it is advisable with color negative material that the red secondary sensitivity in the green-sensitive layer should differ by no more than 3 DIN and preferably by no more than 1 DIN from the red secondary sensitivity in the blue-sensitive layer and that the magenta and yellow secondary gradations obtained on exposure to red light should differ by no more than 25% and preferably by no more than 10% from one another within an exposure range of at least 5 DIN and preferably at least 10 DIN.

In one possible embodiment of the invention, some of the silver halide grains of one layer, preferably the smaller grains of the low-sensitivity layer of a color, where several partial layers are associated with that color, are specifically sensitized to spectral secondary sensitivity in the manner described above. The magnitude of the secondary sensitivity required is best established through the quantity of the spectral (secondary) sensitizer used in combination with the primary spectral sensitivity of the silver halide grains used for this purpose and other relevant layer parameters (for example the coupler and DIR coupler content of the layer; positioning of the layer in the layer sequence, addition of stabilizer and the like).

The necessary gradations of the secondary color density curves are best established for given layer parameters through the quantity of the silver halide grains sensitized to secondary spectral sensitivity.

In another possible embodiment, the emulsion grains of secondary spectral sensitivity are also accommodated in additional layers in the layer sequence.

Basically, the following embodiments are possible:

1. In addition to the AgX-grains of primary spectral sensitivity, AgX-grains sensitized to primary and secondary spectral sensitivity are present in one and the same layer.

2. In addition to the AgX-grains of primary spectral sensitivity, AgX-grains sensitized solely to secondary sensitivity are present in one and the same layer.

3. Only AgX-grains sensitized to primary and secondary sensitivity are present in one and the same layer.

4. The AgX-grains sensitized to primary and secondary sensitivity are present in different layers.

5. Combinations of 1 to 4.

In addition to the AgX-grains of primary spectral sensitivity, AgX-grains sensitized to primary and secondary spectral sensitivity are preferably accommodated in one and the same layer.

The layers as usual contain the color couplers complementary to the primary spectral sensitivity, i.e. the red-sensitive layer contains cyan couplers, the green-sensitive layer magenta couplers and the blue-sensitive layer yellow couplers.

In the production of the photosensitive color photographic recording material, the couplers may be incorporated in known manner in the casting solution of the silver halide emulsion layers or other colloid layers. For example, the oil-soluble or hydrophobic couplers may be added to a hydrophilic colloid solution, preferably from a solution in a suitable coupler solvent (oil former), optionally in the presence of a wetting agent or dispersant. In addition to the binder, the hydrophilic casting solution may of course also contain other typical additives. The solution of the coupler does not have to be directly dispersed in the casting solution for the silver halide emulsion layer or any other water-permeable layer. Instead, it may with advantage even be initially dispersed in an aqueous non-photosensitive solution of a hydrophilic colloid, after which the mixture obtained may be mixed before application with the casting solution for the photosensitive silver halide emulsion layer or any other water-permeable layer, optionally after removal of the low-boiling organic solvent used. Latex-couplers may be also of advantage.

Suitable photosensitive silver halide emulsions are emulsions of silver chloride, silver bromide or mixtures thereof, optionally with a small content of silver iodide of up to 10 mole % in one of the hydrophilic binders normally used. The silver halide grains may have one or more sorts of the usual cristallographic planes (000, 111, 110 e.g.), they can be homodispers, heterodispers, twinned or not twinned, shell-structured of the so-called "core-shell-type", so called "double-structure" grains, "T-grains" and/or mixtures of different grain-types. Gelatin is preferably used as binder for the photographic layers, although it may be completely or partly replaced by other natural or synthetic binders.

The emulsions may be chemically sensitized in the usual way and the emulsion layers and other non-photosensitive layers may be hardened in the usual way with known hardeners.

Each of the photosensitive layers mentioned may consist of a single layer or, in known manner, for example as in the so-called double layer arrangement, may also comprise two or even more partial silver halide emulsion layers (DE-C-No. 1 121 470). Normally, red-sensitive silver halide emulsion layers are arranged nearer the layer support than green-sensitive silver halide emulsion layers which in turn are arranged nearer than blue-sensitive emulsion layers, a non-photosensitive yellow filter layer generally being arranged between the green-sensitive layers and blue-sensitive layers. However, other arrangements are also possible. A non-photosensitive intermediate layer, which may contain agents to prevent the unwanted diffusion of developer oxidation products, is generally arranged between layers of different spectral sensitivity. Where several silver halide emulsion layers of the same spectral sensitivity are present, they may be arranged immediately adjacent one another or in such a way that a photosensitive layer of different spectral sensitivity is present between them (DE-A-No. 1 958 709, DE-A-No. 2 530 645, DE-A-No. 2 622 922).

The color couplers may be both typical 4-equivalent couplers and also 2-equivalent couplers in which a smaller quantity of silver halide is required for dye production. 2-equivalent couplers are known to be derived from the 4-equivalent couplers in that they contain in the coupling position a substituent which is eliminated during the coupling reaction. 2-equivalent couplers include both those which are substantially colorless and also those which have a strong color of their own which either disappears during the color coupling reaction or is replaced by the color of the image dye produced. Couplers of the latter type may also be additionally present in the photosensitive silver halide emulsion layers where they serve as masking couplers for compensating the unwanted secondary densities of the image dyes. However, 2-equivalent couplers also include the known white couplers, although couplers such as these do not produce a dye on reaction with color developer oxidation products. 2-equivalent couplers also include the known DIR couplers, i.e. couplers which in the coupling position contain a releasable group which is released as a diffusing development inhibitor on reaction with color developer oxidation products. Other photographically active compounds, for example development accelerators or fogging agents may also be released from couplers such as these during development.

2-equivalent couplers of the pyrazolo-triazole type are preferred for magenta, while ureido-phenol couplers are preferred for cyan.

In addition to the constituents mentioned, the color photographic recording material according to the invention may contain other additives, for example antioxidants, dye stabilizers and agents for influencing mechanical and electrostatic properties. In order to prevent or avoid the adverse effect of UV light on the colored images produced with color photographic recording materials according to the invention, it is of advantage for example to use UV-absorbing compounds in one or more of the layers contained in the recording material, preferably in one of the upper layers. Suitable UV absorbers are described, for example, in U.S. Pat. No. A-3,253,921, DE-C-No. 2 036 719 and EP-A-No. 0 057 160.

To produce color photographic images, the color photographic recording material according to the invention is developed with a color developer compound. Suitable color developer compounds are any developer compounds which are capable of reacting in the form of their oxidation product with color couplers to form azomethine dyes. Suitable color developer compounds are aromatic compounds containing at least one primary amino group of the p-phenylenediamine type, for example N,N-dialkyl-p-phenylenediamines, such as N,N-diethyl-p-phenylenediamine, 1-(N-ethyl-N-methyl sulfonamidoethyl)-3-methyl-p-phenylenediamine, 1-(N-ethyl-N-hydroxyethyl-3-methyl-p-phenylenediamine and 1-(N-ethyl-N-methoxyethyl)-3-methyl-p-phenylenediamine.

EXAMPLE 1

A multilayer color negative film was prepared by successively applying the layers described hereinafter to a transparent layer support. All quantities are based on 1 $m^2$. The contents of silver halide are described in amounts of equivalent $AgNO_3$. All silver halide-emulsions were stabilized with 0,1 g 4-hydroxy-6-methyl-1,3,3a,7-tetraazainden per 100 g $AgNO_3$.

1st layer: (antihalo layer)
Black colloidal silver sol containing 1.5 g gelatin and 0.33 g Ag 2nd layer: (intermediate layer)
0.4 g gelatin and 0.2 g 2,5-diisooctyl hydroquinone 3rd layer: (low sensitivity, red-sensitized layer)
2.5 g $AgNO_3$ of the medium-sensitivity, spectrally red-sensitized Ag (Br, I)-emulsion RM (1) and 0.6 g $AgNO_3$ of the low-sensitivity, spectrally red-sensitized Ag (Br, I, Cl)-emulsion RN (1), 2.2 g gelatin, 0.6 g cyan coupler corresponding to the formula

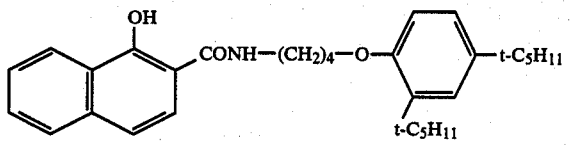

emulsified with 0.48 g dibutylphthalate, 75 mg red mask corresponding to the following formula

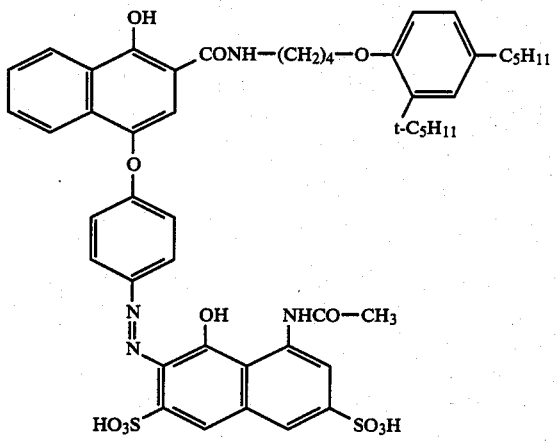

and 40 mg DIR coupler corresponding to the formula

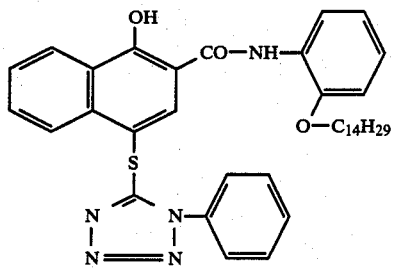

4th layer: (high-sensitivity, red-sensitized layer)
2.7 g $AgNO_3$ of the high-sensitivity, spectrally red-sensitized emulsion RH (1), 1.9 g gelatin, 15 mg of the cyan coupler

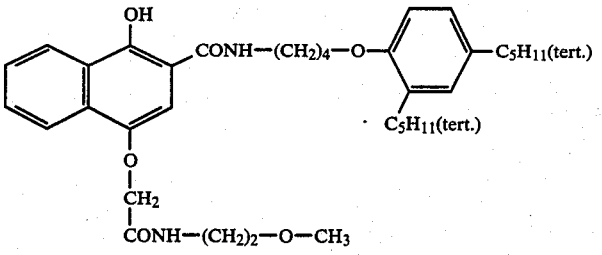

-continued emulsified with 22.5 mg dibutylphthalate.

5th layer: (intermediate layer)

0.7 g gelatin and 0.2 g 2,5-diioctyl hydroquinone

6th layer: (low sensitivity, green-sensitized layer)

1.8 g $AgNO_3$ of the medium-sensitivity, spectrally green-sensitized Ag (Br, I)-emulsion GM (1) and 0.5 g $AgNO_3$ of the low-sensitivity, spectrally green-sensitized Ag (Br, I, Cl)-emulsion GN (1), 1.6 g gelatin, 0.5 g of the magenta coupler

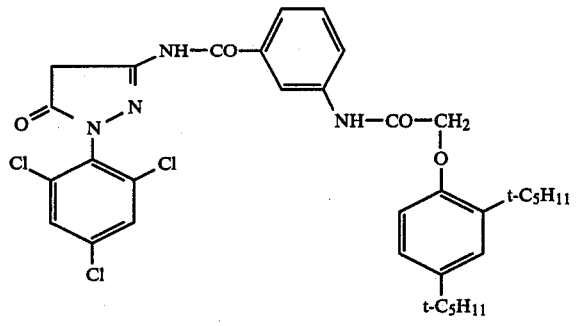

emulsified in 0.5 g tricresyl phosphate, 95 mg of the yellow mask

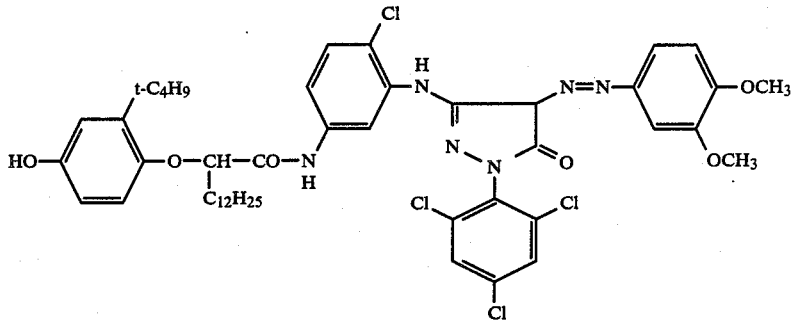

and 65 mg of the DIR coupler

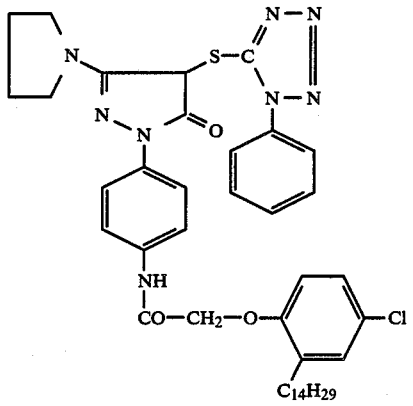

7th layer: (high-sensitivity, green-sensitized layer)

2.1 g $AgNO_3$ of the high-sensitivity, spectrally green sensitized emulsion GH (1), 1.4 g gelatin, 12 mg magenta coupler corresponding to the formula -continued

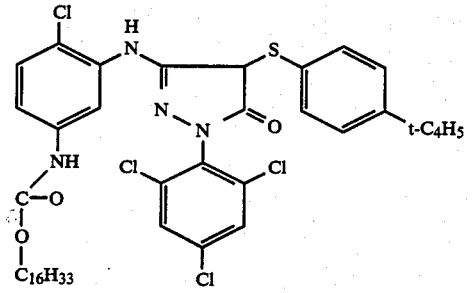

emulsified with 24 mg tricresyl phosphate and 5 mg of the yellow mask used in layer 6.

8th layer: (intermediate layer)
0.5 g gelatin and 0.15 g 2,5-diisooctyl hydroquinone 9th layer: (yellow filter layer)
Yellow colloidal silver sol containing 0.2 g Ag and 0.9 g gelatin.

10th layer: (low-sensitivity, blue-sensitive layer)
0.4 g $AgNO_3$ of the medium-sensitivity, spectrally blue sensitive Ag (Br, I, Cl)-emulsion BM (1) and 0.3 g $AgNO_3$ of the low-sensitivity, spectrally blue-sensitive emulsion BN (1), 0.85 g gelatin, 0.45 g yellow coupler corresponding to the following formula

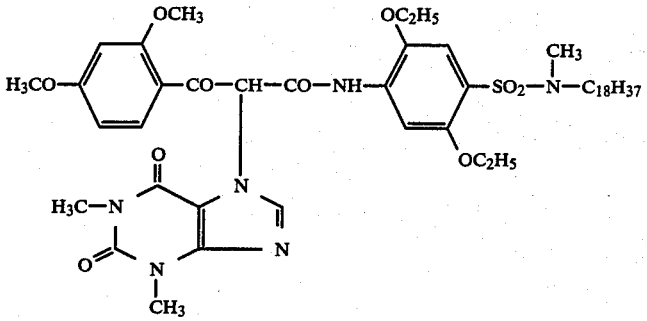

and 0.45 g yellow coupler corresponding to the following formula

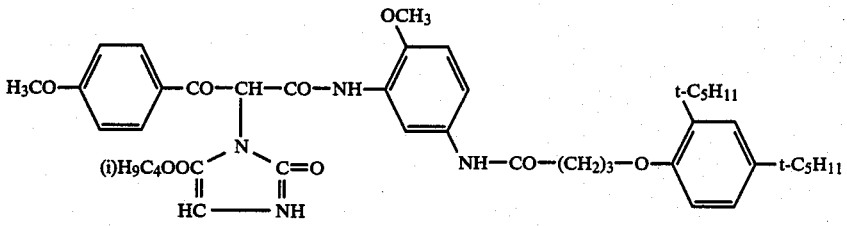

both emulsified together in 1.35 g tricresyl phosphate and 0.2 g DIR coupler corresponding to the following formula

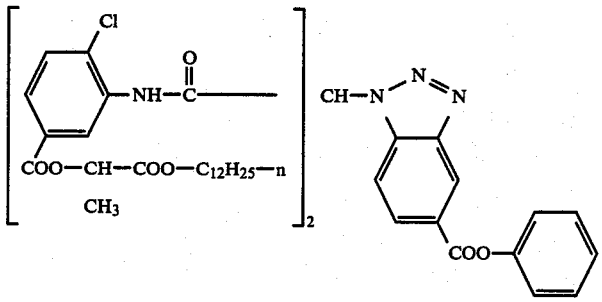

11th layer: (high-sensitivity, blue-sensitive layer)
1.0 g $AgNO_3$ of the high-sensitivity, spectrally blue-sensitive Ag (Br, I, Cl)-emulsion BH (1), 1.2 g gelatin, 0.20 g of the same yellow coupler as in layer 10, first formula, and 0.2 g of the other yellow coupler in layer 10 (second formula) emulsified together with 0.6 g tricresyl phosphate.

12th layer: (protective layer)
1.2 g gelatin
0.2 g UV absorber corresponding to the following formula -continued

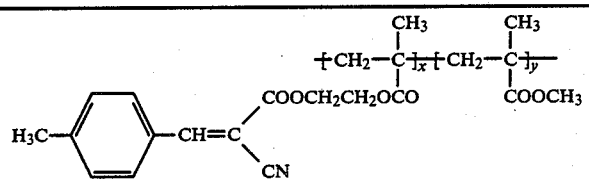

with a ratio by weight x:y of 7:3 and an $M_w$ of approximately 50,000 and 0.3 g UV absorber corresponding to the following formula

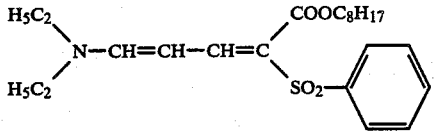

13th layer: (hardening layer)
1.5 g gelatin and 0.7 g of a standard hardener corresponding to the following formula:
$[CH_2{=}CH{-}SO_2{-}CH_2{-}CONH{-}CH_2]_2$

EXAMPLES 2 to 4

The following Examples differ from Example 1 as follows:

In Example 2, some of the silver halide grains of layers 6 (magenta) and 10 (yellow) are also red-sensitized. In Example 3, some of the silver halide grains of layer 3 (cyan) and 10 (yellow) are also green-sensitized and some of the silver halide grains of layers 6 (magenta) and 10 (yellow) are also red-sensitized. Example 4 corresponds to Example 3, except that an additional controlling layer containing silver halide grains of high blue sensitivity and a cyan coupler is present between layers 2 and 3.

EXAMPLE 2

52% by weight of the low-sensitivity, blue-sensitive emulsion BN (1) of layer 10 are spectrally red-sensitized with red sensitizer in such a quantity that, on exposure to red light, the same sensitivity is obtained as on exposure to blue light. The increase in sensitivity to white light produced by this red sensitization is suppressed by as much stabilizer as is required to establish the same sensitivity to white light as existed before the spectral sensitization.

56% by weight of the low-sensitivity emulsion GN (1) present in layer 6 are sensitized with a reduced quantity of green sensitizer and with red sensitizer in such a way that the same sensitivity to white light as in Example 1 is obtained and that the green sensitivity of this GN (1) emulsion component is equal to its red sensitivity.

EXAMPLE 3

The procedure is as in Example 2, except that 50% by weight of the non-red-sensitized component of the low-sensitivity emulsion BN (1) of layer 10 are spectrally green-sensitized to the same sensitivity on exposure to green light as on exposure to blue light. The increase in sensitivity to white light is suppressed by addition of a stabilizer to the value which existed before this spectral sensitization.

62.5% by weight of the low-sensitivity emulsion RN (1) of layer 3 are sensitized with a reduced quantity of red sensitizer and, in addition, also with green sensitizer in such a way that the same sensitivity to white light is obtained as in Example 1 and the red sensitivity of this RN (1) emulsion component is equal to its green sensitivity.

EXAMPLE 4

The procedure is as in Example 3, except that the following layer 2*a* is cast between layers 2 and 3:

Layer 2*a*: 0.5 g $AgNO_3$ of the highly blue-sensitive emulsion BH (1) containing 0.20 g of the same cyan coupler as in layer 4 and 30 mg of the same DIR coupler as in layer 3 and 0.8 g gelatin.

By addition of the stabilizer

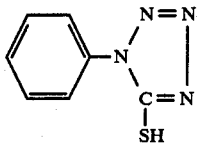

blue sensitivity is reduced from 28.0 DIN to 26.0 DIN.

The silver halide emulsions used in Examples 1 to 4 are characterized in Table 1 below.

The sensitivities indicated in Table 1 are based on the value obtained when the emulsion is cast as a single emulsion together with the other constituents of the layer, in which this emulsion is present, as a single layer, exposed to light of the spectral region indicated behind a grey step wedge and then processed by the same color negative process identified further below.

TABLE 1

| Emulsion | Sensitivity (DIN) | Spectral sensitization | Mean grain diameter | Bromide content (mole %) | Iodide content (mole %) | Chloride content (mole %) |
|---|---|---|---|---|---|---|
| RH (1) | 28.0 | red | 0.85 | 90.5 | 8.5 | 1 |
| RM (1) | 20.2 | red | 0.45 | 95.5 | 4.5 | 0 |
| RN (1) | 11.8 | red | 0.27 | 94.5 | 5.0 | 0.5 |
| GH (1) | 26.5 | green | 0.75 | 92.0 | 7.6 | 0.4 |
| GM (1) | 18.4 | green | 0.42 | 95.0 | 5.0 | 0 |

TABLE 1-continued

| Emulsion | Sensitivity (DIN) | Spectral sensitization | Mean grain diameter | Bromide content (mole %) | Iodide content (mole %) | Chloride content (mole %) |
|---|---|---|---|---|---|---|
| GN (1) | 10.5 | green | 0.25 | 93.1 | 5.4 | 1.5 |
| BH (1) | 25.2 | blue | 0.95 | 90.7 | 9.0 | 0.3 |
| BM (1) | 17.2 | blue | 0.52 | 94.5 | 4.6 | 0.9 |
| BN (1) | 11.8 | blue | 0.22 | 96.4 | 3.0 | 0.6 |

All the silver halide emulsions were stabilized with 0.1 g 4-hydroxy-6-methyl-1,3,3a,7-tetraazaindene per 100 g $AgNO_3$.

One sample of each of the materials of Examples 1 to 4 was exposed to light of the particular spectral color indicated behind a grey step wedge and then processed by the color negative process described in "The British Journal of Photography", (1974), pages 597 and 598.

FIGS. 1 to 6 show the color density curves obtained with the four multilayer color negative materials of Examples 1 to 4 (color densities D yellow (1), magenta (2) and cyan (3) as a function of the exposure log It). FIGS. 7 to 12 show the color density curves (as a function of the exposure log It of the negatives of Examples 1 to 4) which are obtained when the negatives are recopied onto color negative paper to give a positive copy.

Figure 7:
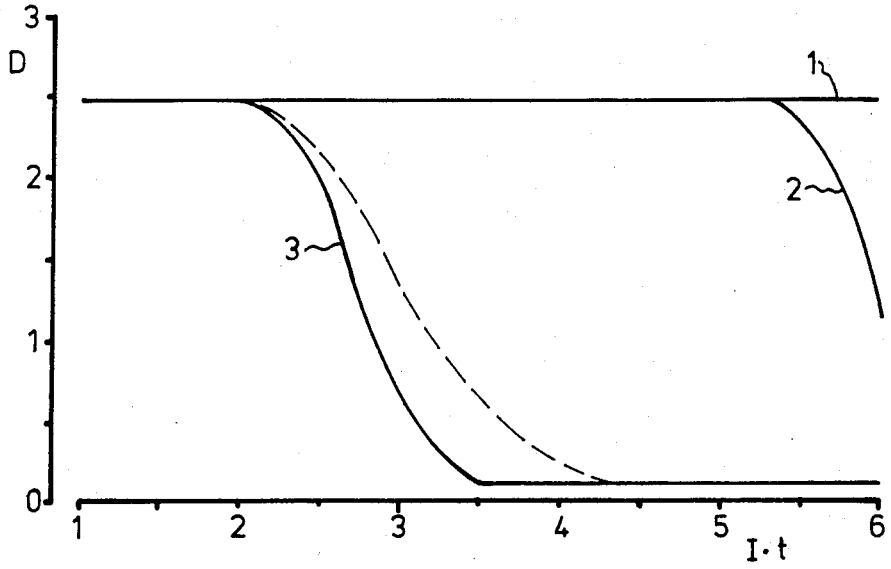

FIGS. 1 and 7 correspond to Example 1 with red exposure.

Figure 2:
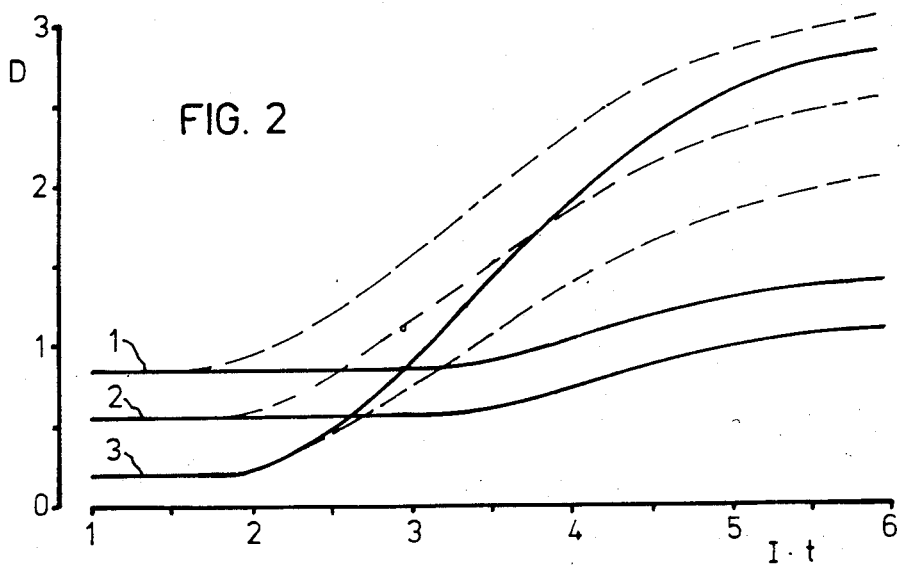
Figure 8:
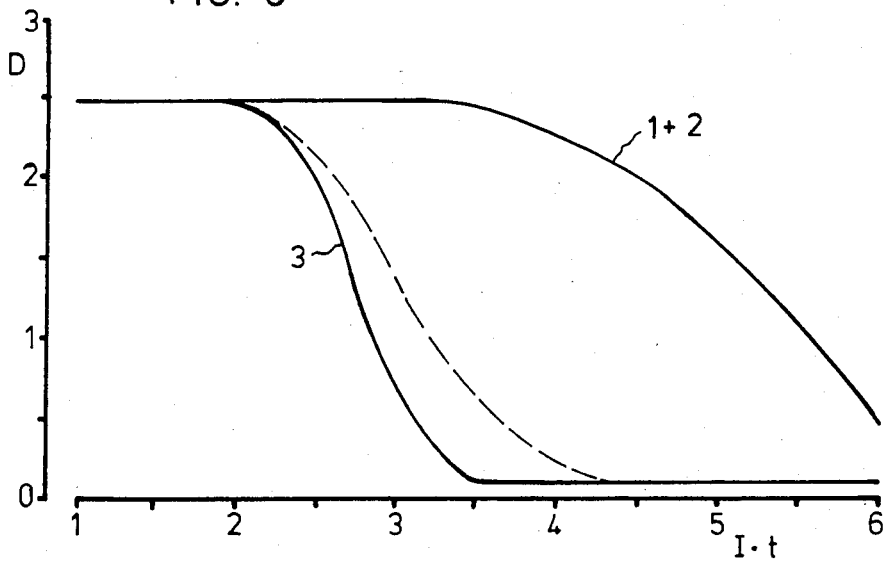

FIGS. 2 and 8 correspond to Example 2 with red exposure.

Figure 3:
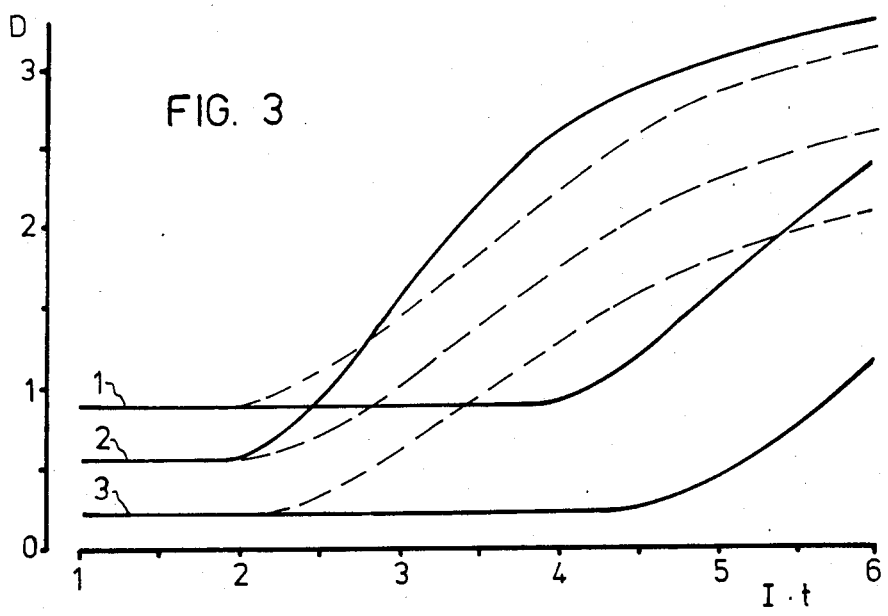
Figure 9:
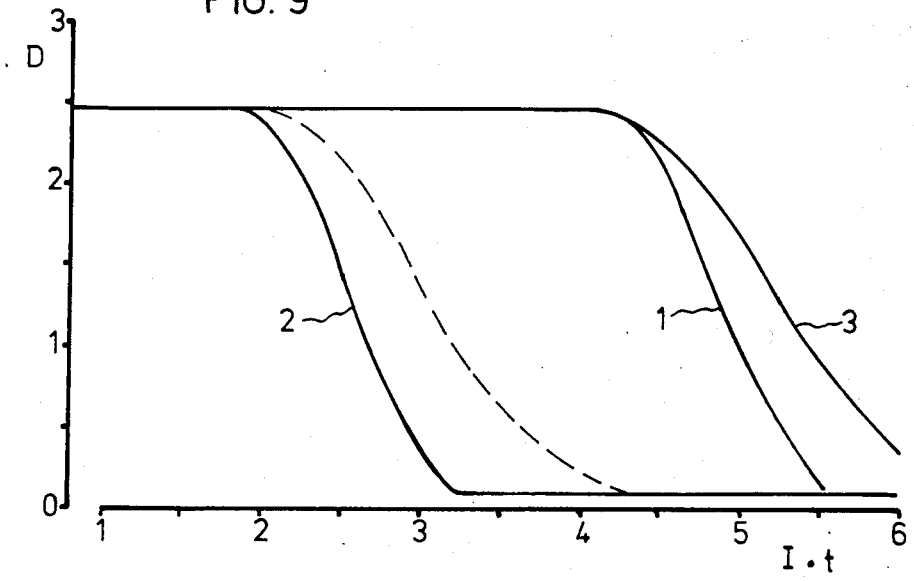

FIGS. 3 and 9 correspond to Example 1 with green exposure.

Figure 4:
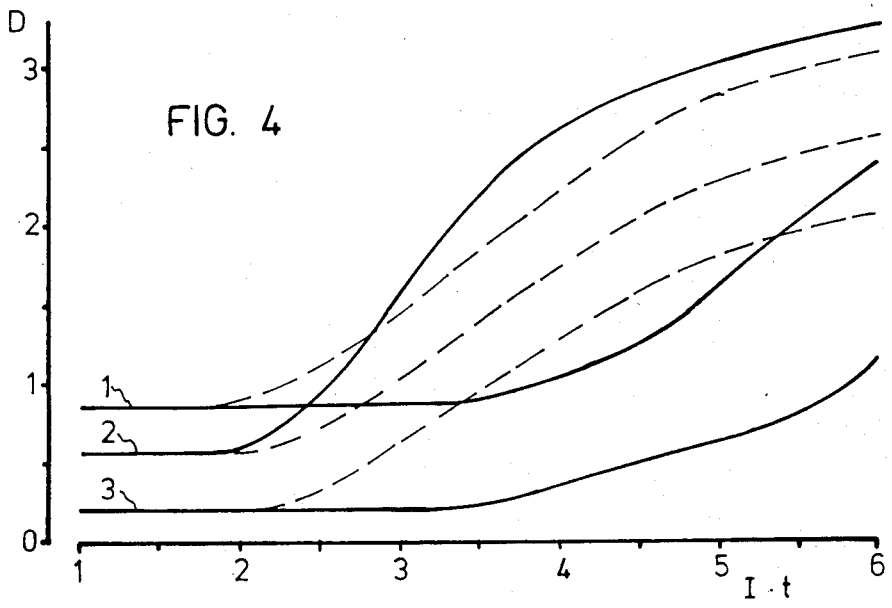
Figure 10:
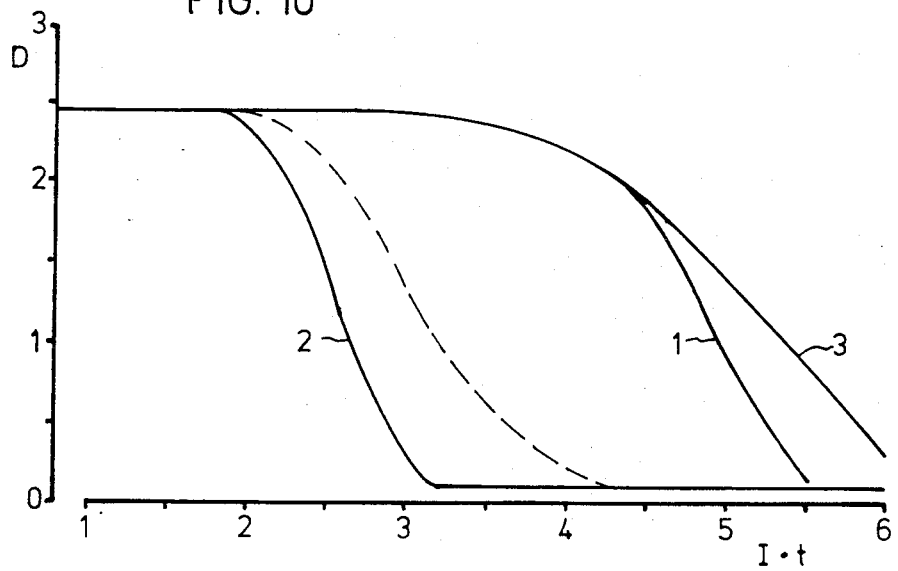

FIGS. 4 and 10 correspond to Example 3 with green exposure.

Figure 5:
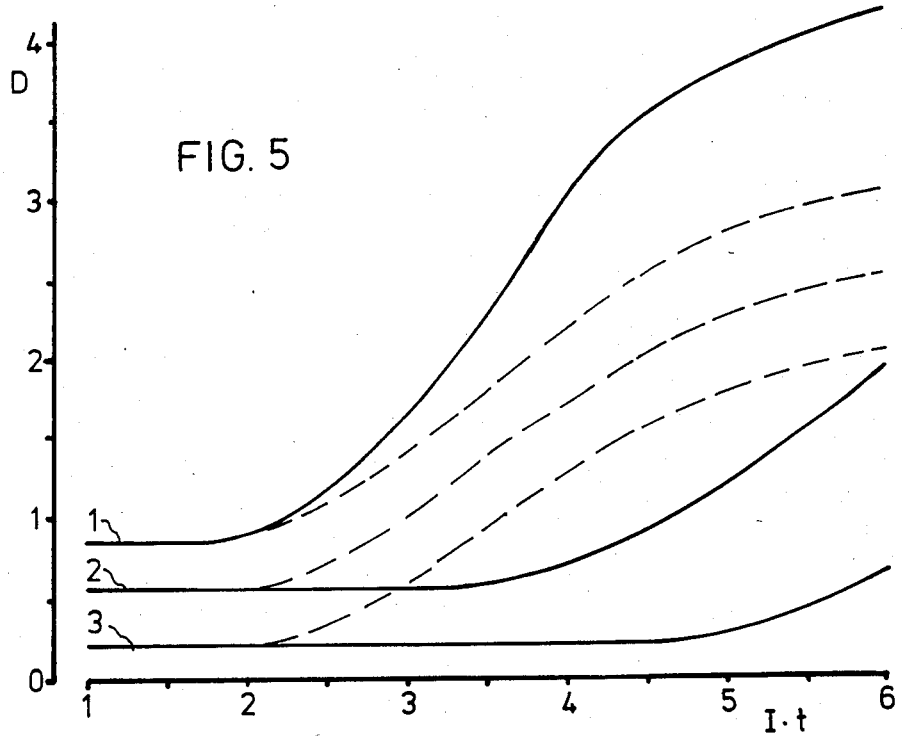
Figure 11:
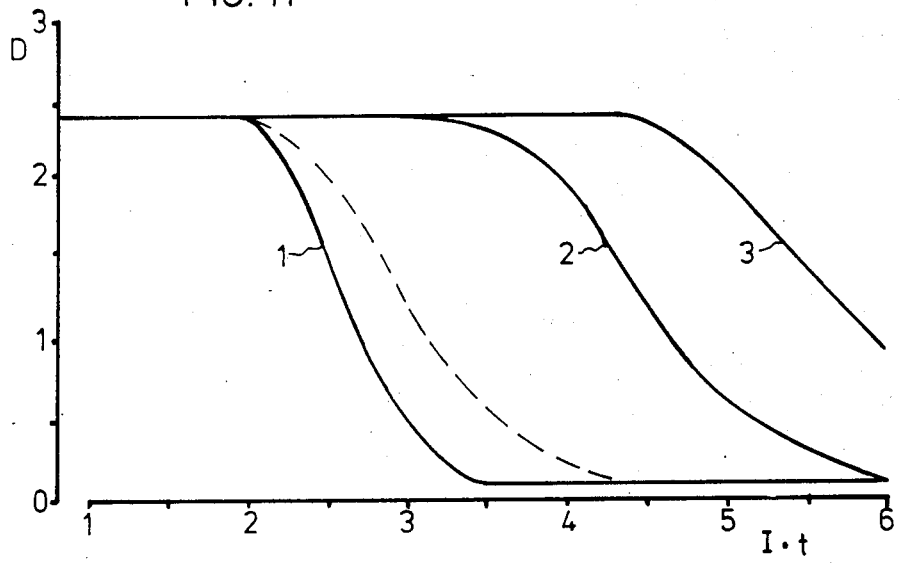

FIGS. 5 and 11 correspond to Example 1 with blue exposure.

Figure 6:
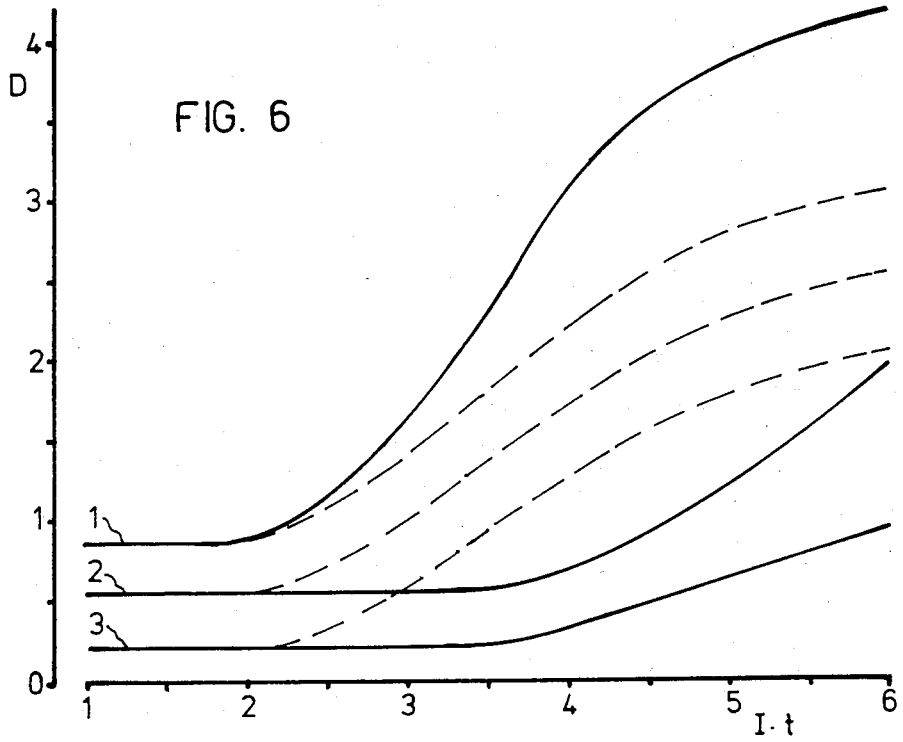
Figure 12:
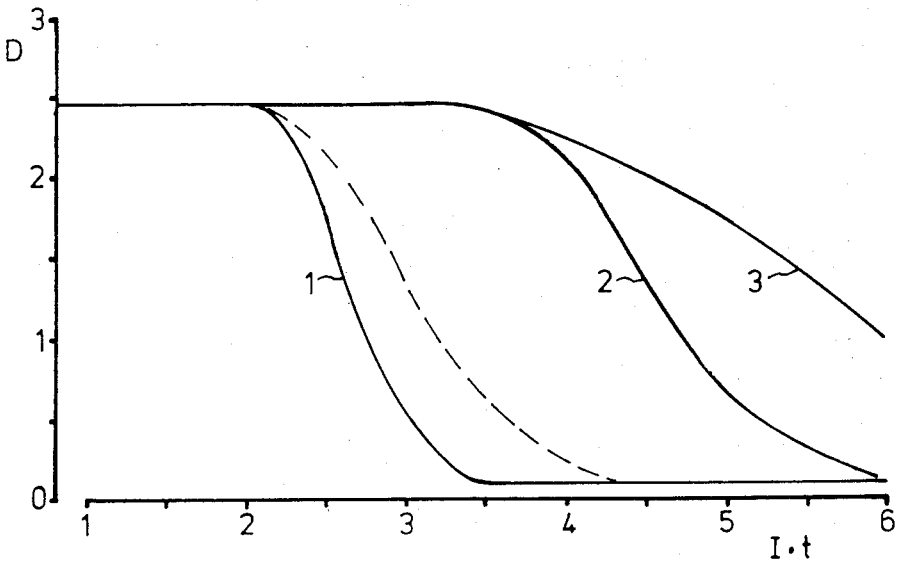

FIGS. 6 and 12 correspond to Example 4 with blue exposure.

The color density curves obtained in Examples 1 to 4 with white exposure are shown in chain lines in the Figures. By "white exposure" is meant an additive exposure of red+green+blue with the same quantities of light as used in the individual exposures.

Red exposure

Red exposure only affects layers 3 and 4 in Example 1. The cyan color density curve steepens considerably compared with that obtained with white exposure on account of the IIE, while the green sensitive layers 6 and 7 and the blue sensitive layers 10 and 11 are not affected and, accordingly, remain gradationless (FIG. 1).

The slight increase in gradation of the magenta curve is far outside the image-used area.

With copies on color negative paper, the grey values (=white exposure of the negative material of Example 1) show gradation in the log It range from 3.5 to 4.5, while with red exposure all three color densities (yellow, magenta and cyan) remain gradationless in that range on account of the IIE (steepening of the cyan color density curve with red exposure as against white exposure) (FIG. 7).

By contrast, with red exposure in Example 2, an increase in the color densities with flatter gradation than with white exposure is observed in the negative at log It>3.5, even with magenta and yellow (FIG. 2). As a result, the yellow and magenta color densities show a gradation in the positive in this range, leading to the required color density graduations in the red details (FIG. 8) without an adverse effect on the advantage of the IIE (reduction in the darkening of the reds through steepening of the cyan color density curve in the positive copy).

Green exposure

As with red exposure, the same advantage is obtained with Example 3 over Example 1 with green exposure, as can be seen by comparing FIG. 3 (negative gradation) and FIG. 9 (positive gradation) according to the prior art with FIG. 4 (negative gradation) and FIG. 10 (positive gradation) according to the invention.

Blue exposure

As with red exposure, the same advantage is obtained with Example 4 over Example 1 with blue exposure, as can be seen by comparing FIG. 5 (negative gradation) and FIG. 11 (positive gradation) according to the prior art with FIG. 6 (negative gradation) and FIG. 12 (positive gradation) according to the invention.

IIES of Examples 1 to 4 (gradation steepening of the primary color density curves at half maximal density of percent with color separation exposure in relation to white exposure):

red exposure from FIG. 1: +85%
green exposure from FIG. 3: +50%
blue exposure from FIG. 5: +45%

EXAMPLE 5

A multilayer color reversal film material was prepared by applying the following layers in the order indicated to a transparent layer support of cellulose triacetate. All the quantities are based on 1 $m^2$. For the silver halide application, the corresponding quantities of $AgNO_3$ are indicated.

The silver halide emulsions used are characterized in Table 2.

The sensitivities indicated are all based on the value obtained when the emulsion is cast as a single emulsion together with the remaining constituents of the layer, in which this emulsion is present, as a single layer and is exposed to light of the particular spectral region indicated.

All the silver halide emulsions were stabilized with 0.1 g 4-hydroxy-6-methyl-1,3,3a,7-tetraazaindene per 100 g $AgNO_3$.

TABLE 2

| Emulsion | Sensitivity (DIN) | Spectral sensitization | Mean grain diameter | Bromide content (mole %) | Iodide content (mole %) |
|---|---|---|---|---|---|
| RH (2) | 25.2 | red | 0.60 μm | 93.5 | 6.5 |
| RM (2) | 14.1 | red | 0.35 μm | 95.0 | 5.0 |
| RN (2) | 9.4 | red | 0.22 μm | 94.0 | 6.0 |
| GH (2) | 23.5 | green | 0.65 μm | 95.7 | 4.3 |
| GM (2) | 12.3 | green | 0.33 μm | 95.2 | 4.8 |
| GN (2) | 7.8 | green | 0.20 μm | 95.2 | 4.8 |
| BH (2) | 23.0 | blue | 0.82 μm | 96.7 | 3.3 |
| BM (2) | 11.5 | blue | 0.38 μm | 95.1 | 4.9 |

TABLE 2-continued

| Emulsion | Sensitivity (DIN) | Spectral sensi-tization | Mean grain diameter | Bromide content (mole %) | Iodide content (mole %) |
|---|---|---|---|---|---|
| BN (2) | 7.5 | blue | 0.30 μm | 95.5 | 4.5 |

Layer 1: (antihalo layer)
Black colloidal silver sol containing 1.5 g gelatin and 0.33 g Ag Layer 2: (intermediate layer)
0.4 g gelatin and 0.2 g 2,5-diisooctyl hydroquinone Layer 3: (1st red-sensitized layer)
0.58 g $AgNO_3$ of the medium-sensitivity, red-sensitized Ag (Br, I)-emulsion RM (2) and 0.38 g $AgNO_3$ of the low-sensitivity, red-sensitized emulsion RN (2), 2.81 g gelatin and 0.26 g cyan coupler corresponding to the following formula

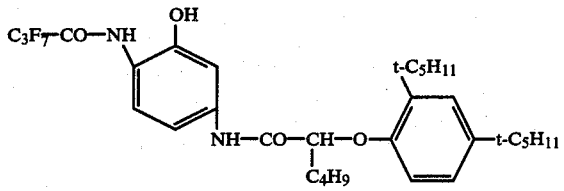

Layer 4: (2nd red-sensitized layer)
0.84 g $AgNO_3$ of the high-sensitivity, red-sensitized Ag (Br, I)-emulsion RH (2), 0.7 g gelatin and 0.58 g of the cyan coupler in layer 3.

Layer 5: (intermediate layer)
1.2 g gelatin and 0.4 g 2,5-diisooctyl hydroquinone Layer 6: (1st green-sensitized layer)
0.54 g $AgNO_3$ of the medium-sensitivity, green-sensitized Ag (Br, I)-emulsion GM (2) and 0.36 g $AgNO_3$ of the low-sensitivity, green-sensitized emulsion GN (2), 0.77 g gelatin and 0.30 g of the magenta coupler of Example 1, layer 6

Layer 7: (2nd green-sensitized layer)
0.94 g of the high-sensitivity, green-sensitized emulsion GH (2), 0.87 g gelatin and 0.64 g of the magenta coupler in layer 6.

Layer 8: (intermediate layer)
0.4 g gelatin and 0.2 g 2,5-diisooctyl hydroquinone Layer 9: (yellow filter layer)
Yellow colloidal silver sol containing 0.2 g Ag and 0.9 g gelatin Layer 10: (1st blue-sensitized layer)
0.50 g $AgNO_3$ of the medium-sensitivity, spectrally blue-sensitized Ag (Br, I)-emulsion BM (2) and 0.28 g $AgNO_3$ of the low-sensitivity, spectrally blue-sensitive Ag (Br, I)-emulsion BN (2), 0.56 g gelatin and 0.47 g yellow coupler corresponding to the following formula -continued

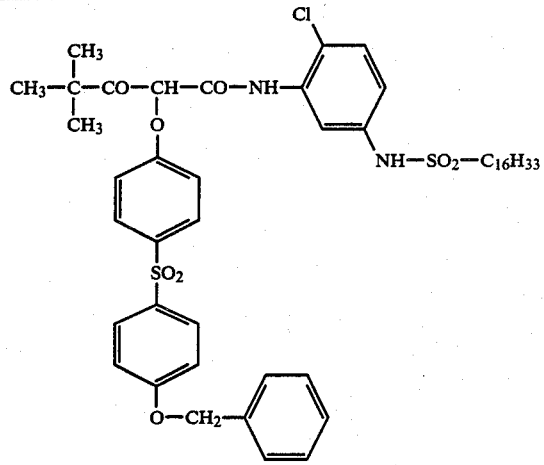

Layer 11: (2nd blue-sensitized layer)
1.3 g $AgNO_3$ of the high-sensitivity, spectrally blue-sensitized emulsion BH (2), 0.76 g gelatin and 1.42 g of the yellow coupler in layer 10.

Layer 12: (protective layer)
1.2 g gelatin

Layer 13: (hardening layer)
1.5 g gelatin and 0.7 g hardener corresponding to the following formula

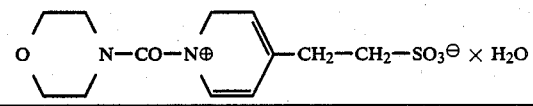

EXAMPLE 6

Example 6 differs from Example 5 in that all the silver halide grains of the low-sensitivity, spectrally blue-sensitized emulsion BN (2) of layer 10 are also spectrally red-sensitized with red sensitizer in such a quantity that the same sensitivity is obtained with red exposure as with blue exposure. The increase in sensitivity to white light produced by this red sensitization is suppressed by as much stabilizer as is necessary to establish the same sensitivity to white light as existed before the spectral red sensitization.

In addition, all the silver halide grains of the spectrally green-sensitized, low-sensitivity emulsion GN (2) of layer 6 were also spectrally red-sensitized. The quantity of green sensitizer is reduced and red sensitizer is added in such a quantity that the same sensitivity to white light is obtained as in Example 5 and the red sensitivity is equal to the green sensitivity.

Samples of the materials of Examples 5 and 6 were exposed to light of the particular spectral color indicated behind a grey step wedge and then processed by the color reversal process described in "The British Journal of Photography", 1981, pages 889, 890, 910, 911 and 919.

Figure 13:
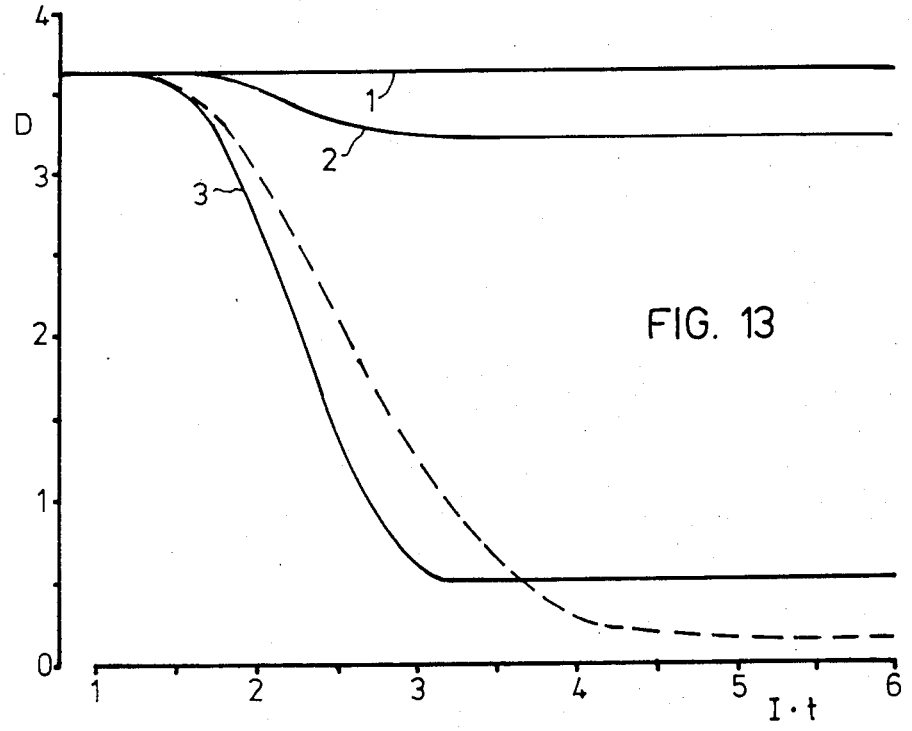
Figure 14:
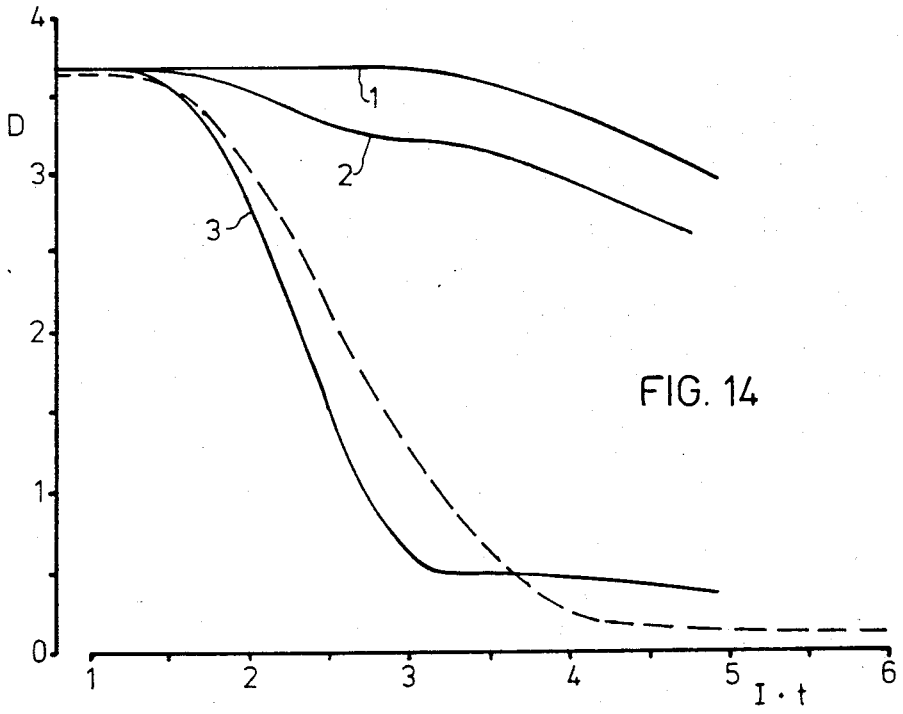

FIGS. 13 and 14 show the color density curves obtained with the multilayer color reversal materials (color densities yellow, magenta and cyan as a function of the exposure (log It) to red light.

The color density curves of the white exposure are shown in chain lines.

It can be seen from FIG. 13 that, with the red exposure of Example 5, all three color density curves (yellow, magenta and cyan) extend horizontally in the log It range of $$3.2 < \log It < 4.2$$

i.e. show no density graduations (in contrast to the white exposure which still produces density graduations in this exposure range).

In Example 5, FIG. 13, the gradation of the magenta curve is limited to the range $$1.7 < \log It < 3.2$$

because it is caused by the magenta secondary density of the cyan image dye and, accordingly, can only occur in the region of the cyan gradation.

With red exposure, the measure applied in Example 6 according to the invention produces a gradation (FIG. 14) in the yellow and magenta color density curves in the range $$\log It > 3.2$$

In the recording of red details, density graduations are thus produced in the same exposure range log It as in the exposure range of white exposure.

IIE of Examples 5 and 6:

Red exposure from Example 13: +40%

The advantage demonstrated for the case of red exposure is also obtained with green and blue exposure in green- and blue-sensitized layers modified in accordance with the invention.

We claim:

1. A color photographic recording material comprising at least one layer of which the primary sensitivity is blue, another layer of which the primary sensitivity is green and a further layer of which the primary sensitivity is red, which layers contain the particular color couplers coupling complementarily thereto and of which the IIE is at least 5% in the blue-sensitive and in the red-sensitive layer and at least 10% in the green-sensitive layer, characterized in that a red secondary sensitivity is produced in at least one layer, of which the primary sensitivity is green, and in at least one layer, of which the primary sensitivity is blue, the primary sensitivity being 8 to 25 DIN higher than the secondary sensitivity in either case.

2. A color photographic recording material as claimed in claim 1, characterized in that the sensitivity difference between primary and secondary sensitivity is 12 to 20 DIN.

3. A color photographic recording material as claimed in claim 1, characterized in that the secondary sensitivities are so established that, in addition to AgX-grains of primary spectral sensitivity, AgX-grains sensitized to primary and secondary spectral sensitivity are present in one and the same layer.

4. A color photographic recording material as claimed in claim 1, characterized in that, with a double-layer or multilayer arrangement of the color-sensitive layers, the spectral secondary sensitivity is established in the silver halide emulsion layer of lowest sensitivity.

5. A color photographic recording material as claimed in claim 1, characterized in that a blue secondary sensitivity is additionally produced in at least one layer, of which the primary sensitivity is red, and a green secondary sensitivity is additionally produced in at least one layer, of which the primary sensitivity is blue, and in at least one layer, of which the primary sensitivity is red, the primary sensitivity being 8 to 25 DIN higher than the secondary sensitivity.

6. A color negative material as claimed in claim 1, characterized in that the red sensitivity in the green-sensitive layer differs from the red secondary sensitivity in the blue-sensitive layer by no more than 3 DIN and in that the magenta and yellow secondary degradations obtained with red exposure differ by no more than 25% from one another within an exposure range of at least 5 DIN.

7. A color negative material as claimed in claim 6, characterized in that the red sensitivity in the green-sensitive layer differs from the red sensitivity in the blue-sensitive layer by no more than 1 DIN and in that the magenta and yellow secondary degradations obtained with red exposure differ by no more than 25% from one another within an exposure range of at least 10 DIN.

* * * * *